US005512415A

United States Patent [19]

Dale et al.

[11] Patent Number: 5,512,415

[45] Date of Patent: Apr. 30, 1996

[54] HIGH CONTRAST PHOTOGRAPHIC SILVER HALIDE MATERIAL

[75] Inventors: Allison H. C. Dale, Rickmansworth; Roger H. Piggin, Abbots Langley; Michael B. Ledger, Norwood; David Beaumond, Chalfont St. Giles, all of England

[73] Assignee: Eastman Kodak Company, Rochester, N.Y.

[21] Appl. No.: 400,078

[22] Filed: Mar. 7, 1995

[30] Foreign Application Priority Data

Mar. 11, 1994 [GB] United Kingdom ..... 9404670

[51] Int. Cl.[6] ..... G03C 1/46

[52] U.S. Cl. ..... 430/264; 430/502; 430/509; 430/598

[58] Field of Search ..... 430/264, 509, 430/598, 502

[56] References Cited

U.S. PATENT DOCUMENTS

| | | | |
|---|---|---|---|
| 4,746,593 | 5/1988 | Kitchin et al. | 430/264 |
| 4,920,034 | 4/1990 | Sasaoka et al. | 430/264 |
| 5,185,232 | 2/1993 | Sasaoka | 430/264 |
| 5,190,850 | 3/1993 | Sakai et al. | 430/503 |
| 5,279,933 | 1/1994 | Gingello et al. | 430/509 |
| 5,372,921 | 12/1994 | Gingello et al. | 430/509 |

*Primary Examiner*—Hoa Van Le
*Attorney, Agent, or Firm*—Alfred P. Lorenzo

[57] ABSTRACT

A high-contrast photographic element, adapted for use in the field of graphic arts, includes a hydrazide nucleator and an amine booster and comprises a silver halide emulsion layer which is capable of forming a latent image under conditions of use and a second silver halide emulsion layer which is not capable of forming a latent image under conditions of use.

10 Claims, No Drawings

HIGH CONTRAST PHOTOGRAPHIC SILVER HALIDE MATERIAL

FIELD OF THE INVENTION

The invention relates to high contrast photographic silver halide materials and particularly to those of the graphic arts type.

BACKGROUND OF THE INVENTION

For many years the very high contrast photographic images needed in the graphic arts and printing industries were obtained by developing a 'lith' emulsion (usually high in silver chloride content) in a hydroquinone, low sulphite, 'lith' developer by the process known as infectious development. However, such low sulphite developers are inherently unstable and are particularly inappropriate for machine processing.

More recently, emulsions containing hydrazine nucleating agents have been used and processed in a high pH (about pH 11.5) developer with conventional amounts of sulphite, hydroquinone and possibly metol or a pyrazolidone. While such a process is better than the low sulphite lith process, the developer still has less sulphite than is optimal and a high pH requirement for it to function correctly. Such a solution is not as stable as is desirable. Additionally high pH solutions are environmentally undesirable because of the care needed in handling and disposing of their effluent.

A further improvement in this area is the introduction of a lower pH process (below pH 11), the use of hydrazides active at this low pH and the additional use of an amine "booster" as described in U.S. Pat. Nos. 4,269,929, 4,668,605 and 4,740,452. The hydrazides proposed for use in such materials are described, for example in U.S. Pat. Nos. 4,278,748, 4,031,127, 4,030,925 and 4,323,643 and in European Patent 0,333,435.

In most photographic materials the type and size of the silver halide grain determines the speed of the material while also affecting the covering power of the silver image formed therefrom. In general smaller sized grains provide higher density and covering power than larger ones. In some materials therefore, there has to be a balance struck between speed and covering power. In high contrast materials another balance between vigorous development and pepper fog (which occurs if development is too vigorous) needs to be achieved.

U.S. Pat. No. 5,185,232 describes a method of forming a high contrast (a $\gamma$ of about 8) by exposing in a camera, through the transparent support to obtain lateral reversal. Such a method of exposure has its own problems as explained in the specification. The material used contains two emulsion layers, the one closer to the support having a speed higher by 0.1 to 0.4 logE than the other one. Both layers are clearly latent image-forming under conditions of use.

U.S. Pat. No. 4 920 034 describes a high contrast photographic material containing emulsions of differing sensitivities. The stated object of this specification is to provide high photographic speed, good dot reproduction and yet retain freedom from pepper fog. While the emulsions contain a hydrazide, the system uses a low sulphite developer having a pH of 11.6. The two emulsion layers used are both spectrally sensitised and image forming as shown in FIGS. 1 and 2.

U.S. Pat. No. 4,746,593 also describes a high contrast material having two emulsion layers, one of them having a lower grain volume than the other. Again a high pH developer is required. The large grain volume emulsion is the image-forming emulsion and the small grain emulsion is preferably a primitive emulsion (not chemically sensitised). In the Examples the emulsion of higher grain volume is primitive, both the emulsions are silver chlorobromide (85% bromide) and the developer has a pH of 12.

PROBLEM TO BE SOLVED BY THE INVENTION

The problem is to provide a hydrazide-containing high contrast photographic material containing an amine booster which is developable at a pH below 11 and which allows savings in sensitising dye, hydrazide and amine components, and improvements in ease of manufacture while retaining desirable density and covering power and avoiding pepper fog.

SUMMARY OF THE INVENTION

The present invention provides a high-contrast photographic element which is developable at a pH of below 11 and adapted for use in the field of graphic arts. The photographic element comprises a support bearing a high-contrast silver halide emulsion layer which is capable of forming a latent image under conditions of use and, in the emulsion layer or an adjacent hydrophilic colloid layer, a hydrazide nucleating agent and an amine booster. The photographic element also comprises a second silver halide emulsion layer which is not capable of forming a latent image under conditions of use. The silver halide contained in the image areas of both silver halide emulsion layers contributes to the visible silver image formed by exposure and processing of the photographic element.

ADVANTAGEOUS EFFECT OF THE INVENTION

While the second layer does not form any latent image on exposure the silver halide contained in the image areas of both layers contributes to the visible silver image because the non latent image-forming emulsion layer is rendered developable in the image areas. As the maximum density of the resultant coating is not primarily dependant upon the latent image-forming emulsion, the invention has the advantage that emulsions of grain size above those used in standard nucleated coatings can be used as the latent image-forming layer to obtain faster photographic speed while those in the non-latent image-forming layer can be smaller thus providing a material with superior density and covering power performance. The fact that the emulsion that forms the latent image makes up only a comparatively small fraction of the total silver, provides the possibility to include options that might normally be precluded because of unacceptable pepper-fog.

The optimisation of the emulsion that does not form the latent image can be extended to include options that would not previously have given acceptable photographic performance. This includes emulsions of very small size and consequently high covering power.

Since only the image-forming emulsion need contain a spectral sensitising dye, only a fraction of the usual amount is required. This gives both cost benefits and allows the use of sensitising dyes that would cause post-process dye stain if coated at normal levels.

Since the latent image-forming and non latent image-forming emulsions are coated in separate layers certain chemicals typically added to image-forming emulsion layers, eg antifoggants, stabilisers, antioxidants, etc. need only be incorporated in the latent image-forming emulsion. The laydown of these chemicals will therefore be reduced and will lead to cost savings and the reduction of any UV density problems which may be associated with these chemicals.

Since the non-latent image-forming emulsion's sensitometric properties are not critical to the final photographic speed of the coated product and since it needs, for example, no sensitising dye, the production of this emulsion requires less components and less stringent control leading to manufacturability and cost benefits.

Film or paper support could be pre-coated with the non-latent image-forming emulsion, requiring only the coating of a thin, spectrally sensitized, emulsion layer and supercoat to produce the final product.

More than one latent image-forming emulsion layer can be coated with a non-latent image-forming emulsion layer; each latent image-forming layer containing an emulsion sensitized to a different wavelength of light. A film or paper would then be produced which would be capable of use on a variety of exposing devices having different light sources.

The present photographic materials are particularly suitable for exposure by red or infra-red light emitting diodes or long wavelength lasers, eg a Helium/Neon or Argon laser.

DETAILED DESCRIPTION OF THE INVENTION

A preferred high contrast photographic material comprising a support bearing a high contrast silver halide emulsion layer which is capable of forming a latent image under conditions of use and, in the emulsion layer or an adjacent hydrophilic colloid layer, a hydrazide nucleating agent and an amine booster such that high contrast is obtainable on processing in a developer having a pH below 11 wherein the material comprises a second silver halide emulsion layer which is not capable of forming a latent image under conditions of use and wherein the silver halide contained in the image areas of both layers contributes to the visible silver image.

The present photographic material containing both a hydrazide nucleating agent and an amine booster provides a high contrast image on processing in a developer having a pH below 11.

Both emulsion layers are preferably chemically sensitised, for example with both sulphur and gold.

The latent image-forming emulsion can be bromoiodide, chtorobromoiodide, bromide, chlorobromide, or chloride. It may contain dopants and should preferably be spectrally sensitized.

The non latent image-forming emulsion can be bromoiodide, chlorobromoiodide, bromide, chlorobromide, or chloride. It may also contain dopants. The emulsion is preferably chemically sensitized but it is not necessary to spectrally sensitise the non latent image-forming emulsion. Preferably the non latent image-forming emulsion is coated closer to the support than the latent image-forming emulsion.

Preferably both the latent image forming emulsion and the non latent image forming emulsion comprise at least 50 mole percent chloride, preferably from 50 to 100 mole percent chloride.

The grain size of the emulsion that forms the latent image preferably ranges from 0.05 to 1.0 μm (microns) in edge length, preferably from 0.05 to 0.5 μm and most preferably from 0.05 to 0.35 μm. The non-sensitive emulsion layer may have grains sizes in the same ranges but preferably are smaller and in the range 0.05 to 0.5 μm preferably 0.05 to 0.35 μm.

As is known in the graphic arts field the silver halide grains may be doped with Rhodium, Ruthenium, Iridium or other Group VIII metals either alone or in combination. The emulsions may be negative or direct positive emulsions, mono- or poly-disperse.

Preferably the silver halide grains are doped with one or more Group VIII metals at levels in the range $10^{-9}$ to $10^{-3}$, preferably $10^{-6}$ to $10^{-3}$, mole metal per mole of silver. The preferred Group VIII metals are Rhodium and/or Iridium.

The emulsions employed and the addenda added thereto, the binders, supports, etc. may be as described in Research Disclosure Item 308119, December 1989 published by Kenneth Mason Publications, Emsworth, Hants, United Kingdom.

The hydrophilic colloid may be gelatin or a gelatin derivative, polyvinylpyrrolidone or casein and may contain a polymer. Suitable hydrophilic colloids and vinyl polymers and copolymers are described in Section IX of Research Disclosure Item 308119, December 1989 published by Kenneth Mason Publications, Emsworth, Hants, United Kingdom. Gelatin is the preferred hydrophilic colloid.

The present photographic materials may also contain a supercoat hydrophilic colloid layer which may also contain a vinyl polymer or copolymer located as the last layer of the coating (furthest from the support). It may contain some form of matting agent.

The vinyl polymer or copolymer is preferably an acrylic polymer and preferably contains units derived from one or more alkyl or substituted alkyl acrylates or methacrylates, alkyl or substituted alkyl acrylamides or acrylates or acrylamides containing a sulphonic acid group.

Suitable hydrophilic binders and vinyl polymers and copolymers are described in Section IX of Research Disclosure Item 308119, December 1989 published by Kenneth Mason Publications, Emsworth, Hants, United Kingdom.

Any hydrazine compound that functions as a nucleator and is capable of providing, with an amine booster, a high contrast image on development at a pH below 11 may be used.

The hydrazine compound is incorporated in the photographic element, for example, it can be incorporated in a silver halide emulsion layer. Alternatively, the hydrazine compound can be present in a hydrophilic colloid layer of the photographic element, preferably a hydrophilic colloid layer which is coated to be adjacent to the emulsion layer in which the effects of the hydrazine compound are desired. It can, of course, be present in the photographic element distributed between or among emulsion and hydrophilic colloid layers, such as undercoating layers, interlayers and overcoating layers. Preferably the hydrazide and booster are present in the non-latent image-forming emulsion layer.

Such hydrazine compounds may have the formula:

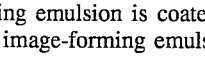

R†–NHNHCHO wherein R† is a phenyl nucleus having a Hammett sigma value-derived electron withdrawing characteristic of less than +0.30.

In the above formula, R† can take the form of a phenyl nucleus which is either electron donating (electropositive) or electron withdrawing (electronegative); however, phenyl nuclei which are highly electron withdrawing produce inferior nucleating agents. The electron withdrawing or electron donating characteristic of a specific phenyl nucleus can be assessed by reference to Hammett sigma values.

Preferred phenyl group substituents are those which are not electron withdrawing. For example, the phenyl groups can be substituted with straight or branched chain alkyl groups (e.g., methyl, ethyl, n-propyl, isopropyl, n-butyl, isobutyl, n-hexyl, n-octyl, tert-octyl, n-decyl, n-dodecyl and similar groups). The phenyl groups can be substituted with alkoxy groups wherein the alkyl moieties thereof can be chosen from among the alkyl groups described above.

The phenyl groups can also be substituted with acylamino groups. Illustrative acylamino groups include acetylamino, propanoylamino, butanoylamino, octanoylamino, benzoylamino, and similar groups.

In one particularly preferred form the alkyl, alkoxy and/or acylamino groups are in turn substituted with a conventional photographic ballast, such as the ballasting moieties of incorporated couplers and other immobile photographic emulsion addenda. The ballast groups typically contain at least eight carbon atoms and can be selected from both aliphatic and aromatic relatively unreactive groups, such as alkyl, alkoxy, phenyl, alkylphenyl, phenoxy, alkylphenoxy and similar groups.

The alkyl and alkoxy groups, including ballasting groups, if any, preferably contain from 1 to 20 carbon atoms, and the acylamino groups, including ballasting groups, if any, preferably contain from 2 to 21 carbon atoms. Generally, up to about 30 or more carbon atoms in these groups are contemplated in their ballasted form. Methoxyphenyl, tolyl (e.g., p-tolyl and m-tolyl) and ballasted butyramidophenyl nuclei are specifically preferred.

Examples of the specifically preferred hydrazine compounds are the following:

1-Formyl-2-(4-[2-(2,4-di-tert-pentylphenoxy)-butyramido]phenyl)hydrazine,

1-Formyl-2-phenylhydrazine,

1-Formyl-2-(4-methoxylphenyl)hydrazine,

1-Formyl-2-(4-chlorophenyl)hydrazine,

1-Formyl-2-(4-fluorophenyl)hydrazine,

1-Formyl-2-(2-chlorophenyl)hydrazine, and

1-Formyl-2-(p-tolyl)hydrazine.

The hydrazine may also comprise an adsorption promoting moiety. Hydrazides of this type contain an unsubstituted or mono-substituted divalent hydrazo moiety and an acyl moiety. The adsorption promoting moiety can be chosen from among those known to promote adsorption of photographic addenda to silver halide grain surfaces. Typically, such moieties contain a sulphur or nitrogen atom capable of complexing with silver or otherwise exhibiting an affinity for the silver halide grain surface. Examples of preferred adsorption promoting moieties include thioureas, heterocyclic thioamides and triazoles. Exemplary hydrazides containing an adsorption promoting moiety include:

1-[4-(2-formylhydrazino)phenyl]-3-methyl thiourea,

3-[4-(2-formylhydrazino)phenyl-5-(3-methyl-2-benzoxazolinylidene)rhodanine-6-([4-(2formylhydrazino)phenyl] ureylene)-2-methylbenzothiazole, N-(benzotriazol-5-yl)-4-(2-formylhydrazino)phenylacetamide, and N-(benzotriazol-5-yl)-3-(5-formylhydrazino-2-methoxyphenyl)propionamide and N-2-(5,5-dimethyl-2-thiomidazol-4-yl-idenimino)ethyl-3-[5-(formylhydrazino)-2-methoxyphenyl]propionamide.

An especially preferred class of hydrazine compounds for use in the elements of this invention are sulfonamido-substituted hydrazines having one of the following structural formulae:

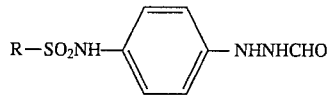

or

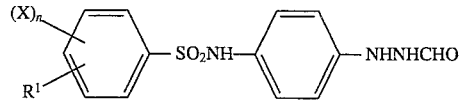

wherein:

R is alkyl having from 6 to 18 carbon atoms or a heterocylic ring having 5 or 6 ring atoms, including ring atoms of sulphur or oxygen;

$R^1$ is alkyl or alkoxy having from 1 to 12 carbon atoms;

X is alkyl, thioalkyl or alkoxy having from 1 to about 5 carbon atoms; halogen; or —$NHCOR^2$, —$NHSO_2R^2$, —$CONR^2R^3$ or —$SO_2R^2R^3$ where $R^2$ and $R^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to 4 carbon atoms, halogen atoms (e.g. chlorine and fluorine) or —$NHCOR^2$— or —$NHSO_2R^2$— where $R^2$ is as defined above. Preferred R alkyl groups contain from 8 to 16 carbon atoms since alkyl groups of this size impart a greater degree of insolubility to the hydrazine nucleating agents and thereby reduce the tendency of these agents to be leached during development from the layers in which they are coated into developer solutions.

Heterocyclic groups represented by R include thienyl and furyl, which groups can be substituted with alkyl having from 1 to 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to 4 carbon atoms, halogen atoms (e.g chlorine or fluorine); or —$NHCOR^2$ or —$NHSO_2R^2$ where $R^2$ is as defined above. Preferred alkyl or alkoxy groups contain from 1 to 5 carbon atoms in order to impart sufficient insolubility to the hydrazine nucleating agents to reduce their tendency to being leached out of the layers in which they are coated by developer solution.

Alkyl, thioalkyl and alkoxy groups which are represented by X contain from 1 to 5 carbon atoms and can be straight or branched chain. When X is halogen, it may be chlorine, fluorine, bromine or iodine. Where more than one X is present, such substituents can be the same or different.

Particularly preferred nuclearors have the following formulae:

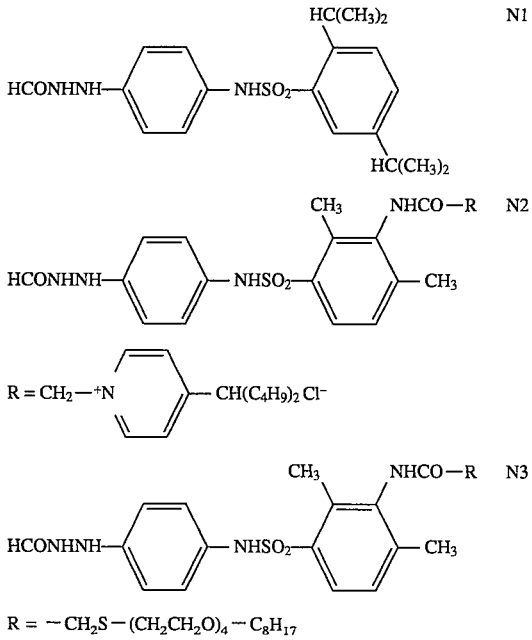

The present materials also contain an amine booster. The amine boosters to be used in the present invention are described in the European Patent referred to above wherein they are defined as an amino compound which:

(1) comprises at least one secondary or tertiary amino group, (2) contains within its structure a group comprised of at least three repeating ethyleneoxy units, and (3) has an n-octanol/water partition coefficient (log P) of at least one, preferably at least three, and most preferably at least four, log P being defined by the formula:

$$\log P = \log \frac{[X_{octanol}]}{[X_{water}]}$$

wherein X is the concentration of the amino compound.

Included within the scope of the amino compounds utilised in this invention are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amine boosters are compounds of at least 20 carbon atoms. It is also preferred that the ethyleneoxy units are directly attached to the nitrogen atom of a tertiary amino group.

Preferably the partition coefficient is at least three, most preferably at least 4.

Preferred amino compounds for the purposes of this invention are bis-tertiary-amines which have a partition coefficient of at least three and a structure represented by the formula:

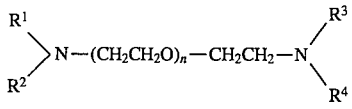

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another preferred group of amino compounds are bis-secondary amines which have a partition coefficient of at least three and a structure represented by the formula:

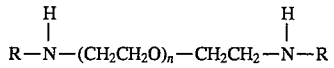

wherein n is an integer with a value of 3 to 50, and more preferably 10 to 50, and each R is, independently, a linear or branched, substituted or unsubstituted, alkyl group of at least 4 carbon atoms.

Particular amine boosters are listed in European Specification 0,364,166.

The present photographic materials preferably contain an antihalation layer on either side of the support. Preferably it is located between the emulsion layer(s) and the support. In a preferred embodiment an antihalation dye is contained in the hydrophilic colloid underlayer. The dye may be dissolved in the underlayer or, preferably, be present in the form of a dispersion of solid particles. Suitable dyes are listed in European Specification 0 364 166.

The light-sensitive silver halide contained in the photographic elements can be processed following exposure to form a visible image by associating the silver halide with an aqueous alkaline medium in the presence of a developing agent contained in the medium or the element. It is a distinct advantage of the present invention that the described photographic elements can be processed in conventional developers as opposed to speciaiised developers conventionally employed in conjunction with lithographic photographic elements to obtain very high contrast images. When the photographic elements contain incorporated developing agents, the elements can be processed in the presence of an activator, which can be identical to the developer in composition, but otherwise lacking a developing agent.

Very high contrast images can be obtained at pH values below 11, preferably in the range of from 10.2 to 10.6, more preferably in the range of 10.3 to 10.5, and especially at 10.4.

The developers are typically aqueous solutions, although organic solvents, such as diethylene glycol, can also be included to facilitate the solvency of organic components. The developers contain one or a combination of conventional developing agents, such as a polyhydroxybenzene, aminophenol, paraphenylenediamine, ascorbic acid, pyrazolidone, pyrazolone, pyrimidine, dithionite, hydroxylamine or other conventional developing agents.

It is preferred to employ hydroquinone and 3-pyrazolidone developing agents in combination. The pH of the developers can be adjusted with alkali metal hydroxides and carbonates, borax and other basic salts. To reduce gelatin swelling during development, compounds such as sodium sulphate can be incorporated into the developer. Chelating and sequestering agents, such as ethylene-diaminetetraacetic acid or its sodium salt, can be present. Generally, any conventional developer composition can be employed in the practice of this invention. Specific illustrative photographic developers are disclosed in the Handbook of Chemistry and Physics, 36th Edition, under the title "Photographic Formulae" at page 3001 et seq. and in Processing Chemicals and Formulas, 6th Edition, published by Eastman Kodak Company (1963). The photographic elements can, of course, be processed with conventional developers for lithographic photographic elements, as illustrated by U.S. Pat. No. 3,573,914 and UK Patent No. 376,600.

The following Examples are included for a better understanding of the invention.

EXAMPLE 1

The photographic element of this example consisted of an ESTAR™ support having thereon an antihalation layer, a non-latent image forming emulsion layer, a latent image forming emulsion layer and a protective supercoat.

The non-latent image forming emulsion layer consisted of a 70:30 chlorobromide cubic monodispersed emulsion (0.11 μm edge length) doped with rhodium at 0.05 mg/Agmole and sulphur and gold chemically sensitized. The emulsion was coated at a laydown of 2.24g Ag/m$^2$ in a vehicle of 1.5 g/m$^2$ gel and 0.45 g/m$^2$ latex copolymer of methyl acrylate, 2-acrylamido-2-methylpropanesulphonic acid and the sodium salt of 2-acetoxyethyl methacrylate (88:5:7 by weight). Other addenda included 6.92 mg/m$^2$ nucleator (structure I) and 78 mg/m$^2$ amine booster (structure II).

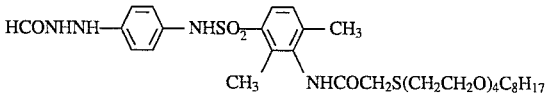

STRUCTURE I $(C_3H_7)_2N(CH_2CH_2O)_{14}CH_2CH_2N(CH_3H_7)_2$

STRUCTURE II

The latent image forming emulsion layer consisted of a 70:30 chlorobromide cubic monodispersed emulsion (0.11 μm edge length) doped with rhodium at 0.077 mg/Agmole, sulphur and gold chemically sensitized and spectrally sensitised with 390 mg/Agmole of sensitizing dye (1) of the formula:

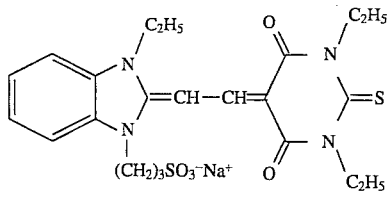

Other addenda included 2-mercaptomethyl-5-carboxy-4-hydroxy-6-methyl-1,3,3a,7-tetraazaindene and 1-(3-acetamidophenyl)-5-mercaptotetrazole.

The latent image-forming emulsion was coated at a laydown of 0.56g Ag/m$^2$ in a vehicle of 1.85g/m$^2$ gel and 112 mg/m$^2$ of latex copolymer of methyl acrylate, 2-acrylamido-2-methylpropanesulphonic acid and the sodium salt of 2-acetoxyethyl methacrylate (88:5:7 by weight).

The supercoat contained matte beads and surfactants and was coated at a gel laydown of 0.5g/m$^2$.

This photographic element was compared to one in which the latent image-forming emulsion, dyed at the same rate per mole, was coated at a laydown of 3.3g/m$^2$. No other emulsion was present in this element.

The above elements were evaluated by exposing through a 0.1 increment step wedge with a $10^{-6}$s flash sensitometer fitted with WRATTEN™4+2B filters and then processed in KODAK™ MX1582 Developer (diluted 1+2) at 35° C. for 30 seconds.

Both elements achieved a maximum density of >5.5 and had the same photographic speed.

Had the element demonstrating this invention not accessed the silver from the layer containing the non latent image forming emulsion the expected maximum density based upon the known covering power of such an emulsion would have been about 1.06. Examination of sections of the element after processing through a developer with reduced nucleation activity shows that the emulsion in the non-latent image forming layer has not been developed.

EXAMPLE 2

A photographic element was prepared similarly to that described in Example 1.

The non-latent image forming emulsion layer consisted of a 70:30 chlorobromide cubic monodispersed emulsion (0.18 μm edge length) doped with rhodium at 0.05 mg/Agmole and sulphur and gold chemically sensitized. The emulsion is coated at a laydown of 2.52 g Ag/m$^2$ in a vehicle of 1.5 g/m$^2$ gel and 0.45 g/m$^2$ latex copolymer of methyl acrylate, 2-acrylamido-2-methylpropanesulphonic acid and the sodium salt of 2-acetxyethyl methacrylate (88:5:7 by weight). Other addenda included 6.92 mg/m$^2$ nucleator (structure I), 78 mg/m$^2$ amine booster (structure II).

The latent image forming emulsion layer consisted of a 70:30 chlorobromide cubic monodispersed emulsion (0.18 μm edge length) doped with rhodium at 0.05 mg/Agmole, sulphur and gold chemically sensitized and spectrally sensitised with 390 mg/Agmole of sensitizing dye (1) of Example 1. Other addenda included 2-mercaptomethyl-5-carboxy-4-hydroxy-6-methyl-1,3,3a,7-tetraazaindene and 1-(3-acetamidophenyl)-5-mercaptotetrazole.

This emulsion is coated at a laydown of 0.28 g Ag/m$^2$ in a vehicle of 1.85 g/m$^2$ gel and 112 mg/m$^2$ of latex copolymer of methyl acrylate, 2-acrylamido-2-methylpropanesulphonic acid and the sodium salt of 2-acetxyethyl methacrylate (88:5:7 by weight).

The supercoat was as described in Example 1.

This element was compared to a comtrol in which the latent image forming emulsion, dyed at the same rate per mole, was coated at a laydown of 2.8 g/m$^2$. No other emulsion was present in this element (Control 1).

A further control element was prepared in which the latent image forming emulsion was coated at 0.28 g/m$^2$. No other emulsion was present in this element (Control 2).

The above elements were evaluated by exposing through a 0.1 increment step wedge with a $10^{-6}$s flash sensitometer fitted with WRATTEN™ 4+2B filters and then processed in KODAK MX1582 Developer (diluted 1+2) at 35° C. for 30 seconds.

| Element | Dmax |
|---|---|
| Example 2 | 4.96 |
| Control 1 | 4.69 |
| Control 2 | 0.34 |

The maximum density achieved by the Example 2 element was 4.96 relative to 4.69 achieved by Control 1. The maximum density achieved by the element (Control 2) containing only 0.28 g/m$^2$ of the latent image forming emulsion was 0.34.

The invention has been described in detail, with particular reference to certain preferred embodiments thereof, but it should be understood that variations and modifications can be effected within the spirit and scope of the invention.

We claim:

1. A high-contrast photographic element which is developable at a pH of below 11 and adapted for use in the field of graphic arts; said photographic element comprising a support bearing a high-contrast silver halide emulsion layer which is capable of forming a latent image under conditions of use and, in said emulsion layer or an adjacent hydrophilic colloid layer, a hydrazide nucleating agent and an amine booster; and said photographic element additionally comprising a second silver halide emulsion layer which is not capable of forming a latent image under conditions of use; both silver halide emulsion layers contributing to the visible silver image formed by exposure and processing of said photographic element.

2. A photographic element as claimed in claim 1 wherein both of said emulsion layers are chemically sensitized.

3. A photographic element as claimed in claim 1, wherein the silver halide in each of said emulsion layers is at least 50 mole percent silver chloride.

4. A photographic element as claimed in claim 1, wherein the silver halide emulsion layer which is not capable of forming a latent image contains no sensitizing dye.

5. A photographic element as claimed in claim 1, wherein the silver halide emulsion layer which is not capable of forming a latent image contains no antifoggant or stabilizer.

6. A photographic element as claimed in claim 1, comprising more than one latent-image-forming emulsion layer wherein each of said latent-image-forming emulsion layers is spectrally sensitized to a different region of the spectrum.

7. A photographic element as claimed in claim 1, wherein the silver halide grains in each of said emulsion layers are doped with a Group VIII metal at a level in the range of from $10^{-9}$ to $10^{-3}$ moles of metal per mole of silver.

8. A photographic element as claimed in claim 1, wherein the silver halide grains in the emulsion layer which is capable of forming a latent image have a grain size in the range of from 0.05 to 1.0 μm.

9. A photographic element as claimed in claim 1, wherein the silver halide grains in the emulsion layer which is not capable of forming a latent image have a grain size in the range of from 0.05 to 0.5 μm.

10. A photographic element as claimed in claim 1, wherein said emulsion layer which is not capable of forming a latent image is positioned nearer to said support than said emulsion layer which is capable of forming a latent image.

* * * * *